US005461768A

United States Patent [19]

Matsumoto et al.

[11] Patent Number: 5,461,768

[45] Date of Patent: Oct. 31, 1995

[54] ELECTRICALLY HEATABLE CAULKING SYSTEM AND METHOD

[75] Inventors: Jiro Matsumoto, Shizuoka; Ikuo Yanagisawa, Tokyo, both of Japan

[73] Assignee: Nippon Light Metal Co., Ltd., Tokyo, Japan

[21] Appl. No.: 326,057

[22] Filed: Oct. 19, 1994

Related U.S. Application Data

[63] Continuation of Ser. No. 203,438, Mar. 1, 1994, abandoned, which is a continuation-in-part of Ser. No. 43,401, Apr. 6, 1993, abandoned.

[30] Foreign Application Priority Data

Apr. 10, 1992 [JP] Japan ..... 4-907792

[51] Int. Cl.[6] ..... B21D 39/00; B21J 5/08

[52] U.S. Cl. ..... 29/509; 29/524.1; 29/DIG. 13; 72/342.92; 72/342.96; 72/700; 219/150 R; 219/150 V; 219/152

[58] Field of Search ..... 29/509, 514, 521, 29/524.1, DIG. 13; 72/342.5, 342.92, 342.96, 700; 219/118, 119, 150 R, 150 V, 151, 152

[56] References Cited

U.S. PATENT DOCUMENTS

| | | | |
|---|---|---|---|
| 2,206,426 | 7/1940 | Phelps | 219/150 V |
| 2,237,121 | 4/1941 | Stine et al. | 219/150 V |
| 5,054,301 | 10/1991 | Soga et al. | 219/150 R X |

FOREIGN PATENT DOCUMENTS

| | | | |
|---|---|---|---|
| 2710657 | 9/1978 | Germany . | |
| 58-29538 | 2/1983 | Japan | 72/342.92 |
| 58-212832 | 12/1983 | Japan . | |
| 63-224822 | 9/1988 | Japan | 29/524.1 |
| 352509 | 8/1931 | United Kingdom . | |
| 444396 | 3/1936 | United Kingdom | 219/150 R |

OTHER PUBLICATIONS

Patent Abstract of Japan, Apr. 1985 vol. 9, No. 87, p. 73 M 372, #59–215224 Dec. 5, 1984.

Patent Abstract of Japan, Dec. 1986 vol. 10, No. 372, p. 108 M 544, #61–165247 Jul. 25, 1986.

Soviet Inventions Illustrated, Jan. 1981, section EL, week C47, p. 30, #SU 727 309 (Smirnov).

Soviet Patents Abstract, Sep. 1991, section S–X, week 9129, p. 19, #SU 1606 254 (Ufa).

Haessly, W. F., "Metal Gathering by the Resistance—Heating Process", The Welding Journal, pp. 132–140, Feb. 1957.

*Primary Examiner*—S. Thomas Hughes

*Attorney, Agent, or Firm*—McAulay Fisher Nissen Goldberg & Kiel

[57] ABSTRACT

An electrical caulking method for a work made from a magnesium or a magnesium alloy wherein a caulking pin integrally projects from a body, wherein an electric caulking apparatus having two opposing electrodes is used. The work is held between the opposing electrodes so that one electrode contacts the caulking pin and the other electrode contacts the body while an electric current is applied between the electrodes and pressure is exerted therebetween, thereby caulking the caulking pin into a desired shape, and providing at least the one electrode that is brought into contact with the caulking pin of the work of a material having low thermal diffusivity and which is difficult to alloy with magnesium. The invention is also concerned with an electrical caulking system using an apparatus having two opposing electrodes for attaching the two members together and the members are positioned together so that the caulking pin is inserted into the inserting hole aligned with the caulking pin and making at least the one electrode which contacts the caulking pin of the work of a material having a low thermal diffusivity and difficult to alloy with magnesium.

16 Claims, 1 Drawing Sheet

ELECTRICALLY HEATABLE CAULKING SYSTEM AND METHOD

This is a continuation, of application Ser. No. 08/203,438 filed on Mar. 1, 1994, now abandoned, which, in turn, is a continuation-in-part of Ser. No. 08/043,401 filed on Apr. 6, 1993, now abandoned.

BACKGROUND OF THE INVENTION

1. Field of the Invention

This invention relates to an electrically heatable caulking method and, more particularly, to an electrically heatable caulking method adapted for caulking a work made of magnesium or any suitable magnesium alloy and having one or more caulking pins.

2. Description of the Related Art

For instance, a light weight aluminum alloy or a steel plate has been conventionally and widely used as structural members of a vehicle, such as a cylinder head cover or a buffer plate. When these members are secured to another member, a so-called electrically heatable caulking method is widely used as mentioned below. First, caulking pins provided on one of the members are inserted into corresponding caulking pin holes formed in the other member. These two members are thus superimposed together and placed between two opposing electrodes, by which an alternative electric current is supplied between these two members and, in addition, a pressure force is also exerted therebetween.

Also, recently, research has been conducted so as to discover a method using a magnesium or a magnesium alloy, having a specific gravity smaller than that of the above-mentioned aluminum alloy, in place of the latter.

In an application of structural members of a vehicle, it is possible to use a magnesium alloy as the material of a cylinder head cover. However, in the prior art, it has been conventionally considered that, apart from a light weight aluminum alloy, it is technically difficult to use a magnesium alloy in an electrically heatable caulking method for attaching a cylinder head cover made of a magnesium alloy to a buffer plate, because a plastic working of magnesium alloy is more difficult than that of an aluminum alloy and, therefore, according to a conventional caulking method, it is difficult to work the magnesium alloy to a desired shape.

SUMMARY OF THE INVENTION

Under the above circumstances, according to the inventor's research, it has been found that, if the electrodes are made of a specified material and if the welding conditions, such as current ampere for welding, welding time, pressure or the like, are suitably selected, it will be possible to use a magnesium or magnesium alloy to obtain a favorable caulking.

An object of the present invention is to provide an electrical caulking method that can use a magnesium or magnesium alloy.

In accordance with the present invention, there is provided an electrical caulking method for a work that is made from a magnesium or a magnesium alloy and comprises a body and a caulking pin integrally projecting from the body. The method is carried out using an electric caulking apparatus having first and second opposing electrodes and comprises holding the work between the opposing first and second electrodes in such a manner that the first electrode contacts the caulking pin and the second electrode contacts the body, applying an electric current between the first and second electrodes, and exerting pressure between the first and the second electrodes, to thereby caulk the caulking pin into a desired shape; and providing at least the first electrode that is brought into contact with the caulking pin of the work of a material having low thermal diffusivity and which is difficult to alloy with magnesium.

A feature of the invention is that the first electrode contains at least 75% tungsten and the remainder, if any, Cu and the second electrode is a Cr-Cu alloy containing 1 to 5% Cr with the remainder Cu.

The invention is also concerned with an electrical caulking system for attaching a first member together with a second member and using an electric caulking apparatus provided with first and second opposing electrodes, at least the first member being made of magnesium or a magnesium alloy and comprises a body and a caulking pin integrally projecting from the body, and the second member has a caulking pin inserting hole at a corresponding position aligned with the caulking pin. In the system, the first and second members are positioned together in such a manner that the caulking pin is inserted into the caulking pin inserting hole aligned with the caulking pin, and the first and second members are held between the opposing first and second electrodes in such a manner that the first electrode contacts the caulking pin and the second electrode contacts the body, an electric current is supplied between the first and second electrodes, a pressure is exerted between the first and second electrodes for caulking the caulking pin into a desired shape, and having at least the first electrode which contacts the caulking pin of the work made of a material having a low thermal diffusivity and difficult to alloy with magnesium.

The above method may further comprise a second work that is to be attached together with said first work; said method comprising: a step of placing said first and second members together in such a manner that said caulking pin is inserted into said caulking pin inserting hole.

It is advantageous for said material, to be tungsten, having a low thermal diffusivity and difficulty alloying with magnesium.

It is also advantageous for an alternate electric current to be supplied between said first and second electrodes.

It is still advantageous for an electric current density to be 100–160 A/mm$^2$.

It is further advantageous for a pressure of 13–22 Kgf/mm$^2$ to be exerted between said first and second electrodes.

It is still further advantageous for said second electrode, which contacts said body of the work to be made of a Cr-Cu alloy.

It is further advantageous that the first electrode contain at least 75% tungsten and the remainder, if any, copper, and that the second electrode is a Cr-Cu alloy containing 1 to 5% Cr and the remainder Cu.

In the present invention, the caulking pin of the work made of magnesium or a magnesium alloy can be appropriately plastically deformed and a good caulking effect can be obtained.

DESCRIPTION OF THE PREFERRED EMBODIMENTS

Figure 1:
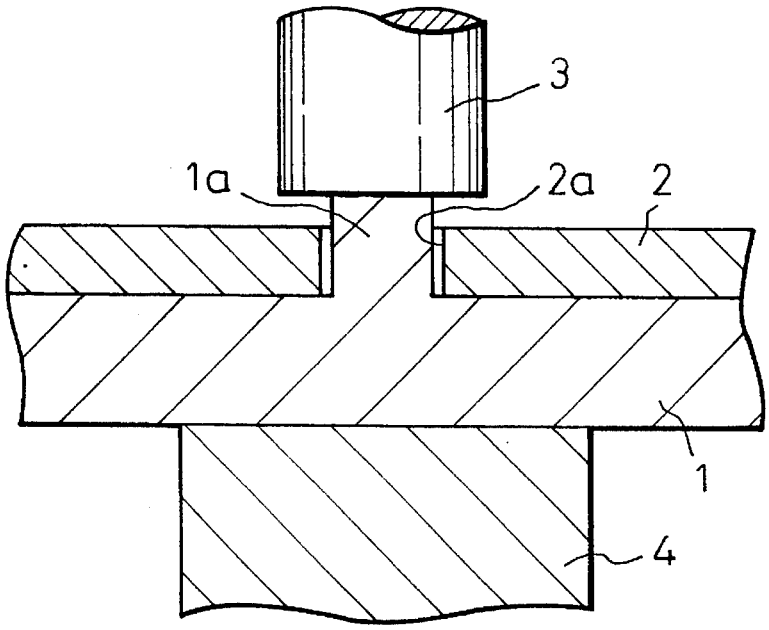
FIG. 1 is a cross-sectional view for illustrating an electrically heatable caulking method according to the present invention (before caulking)
Figure 2:
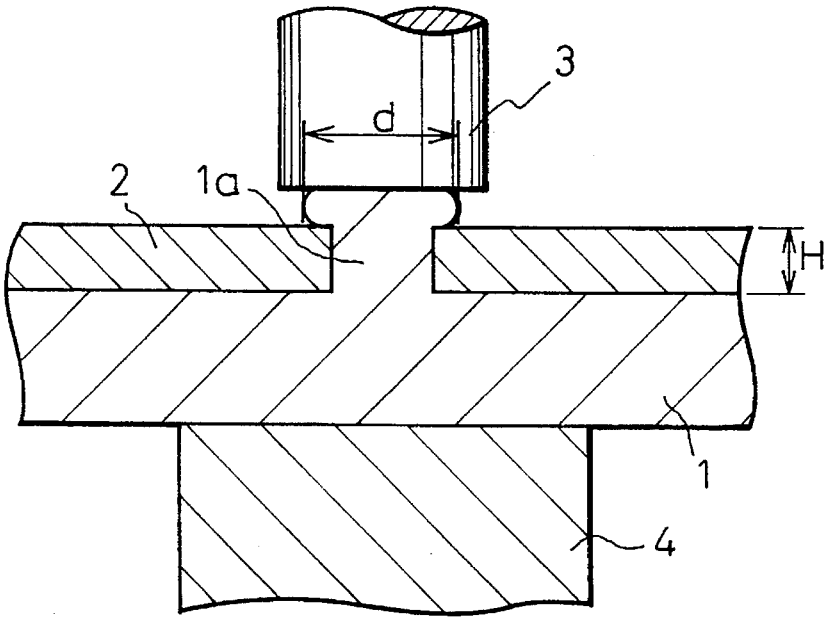
FIG. 2 is a cross-sectional view similar to FIG. 1, but illustrating the state after caulking.

Referring now to the drawings, wherein FIGS. 1 and 2 illustrate an electrically heatable caulking method according to the present invention.

The work 1 is a member made of a magnesium alloy and comprises a plate-like body having a thickness of 6.0 mm. The body 1 is provided integrally at a predetermined position or positions with one or more caulking pins 1*a* projected from the body 1. The caulking pins 1*a* have a diameter of 6.9 mm and a height of 5.5 mm.

Another work 2, which is to be attached to the work 1 by a caulking process according to the present invention, is a plate made of the same material as the member 1, i.e., a magnesium alloy. Otherwise, the plate 2 may be made of another material. The plate 2 is provided at a corresponding position or positions for the caulking pin 1*a* with one or more caulking pin inserting holes 2*a*, with a diameter of 7.9 mm.

When attaching the plate 2 together with the member 1, as shown in FIG. 1, the plate 2 is first placed on the member 1 in such a manner that the caulking pins 1*a* are fit into the caulking pin inserting holes 2*a*. These members 1 and 2 are then held between opposing electrodes 3 and 4 in such a manner that the upper electrode 3 contacts the upper end of the caulking pin 1*a* and the lower electrode 4 contacts the member 1 at a corresponding position, respectively.

At least one of the electrodes 3 and 4, i.e., the upper electrode 3 that contacts the caulking pin 1*a* of the member 1 of a magnesium alloy is made of tungsten with a diameter of 20.0 mm in this embodiment, because tungsten is a typical material having high melting point and hardness, low thermal diffusivity and difficulty alloying with magnesium. However, any other material having similar characteristics can also be used for this purpose.

In this embodiment, the other electrode, i.e., the lower electrode 4 is made of Cr-Cu alloy (content of Cr: 1.0%) and has an outer diameter of 50.0 mm.

When alternate electric power and pressure are exerted simultaneously between the opposing upper and lower electrodes 3 and 4, the caulking pin or projection 1*a* is deformed so as to close the caulking pin inserting hole 2*a*, as shown in FIG. 2.

It has been found that a most favorable caulking result can be obtained if the caulking operation is conducted under any selected conditions within the following current and pressure ranges. Consequently, the pressure exerted between said upper and lower electrodes 3 and 4 is 350–800 Kgf, the current ampere is 3,000–8,000 A, and the electric power supply time is 0.2–1.6 sec.

The following Tables 1 and 2 show the experimental results of the above-mentioned caulking operation. The evaluation conditions are as follows: With respect to the initial condition before deformation by caulking, the caulking pin 1*a* has a diameter of 6.9 mm and a height of 5.5 mm; ⊙ indicates "good" samples, i.e., if the caulking pin 1*a*, after being deformed by the caulking process, has an outer diameter d, more than 9.8 mm, at a deformed head portion thereof, and a height H of not more than 3.0 mm, and there are no excess slits or crushes; ○ indicates "agreeable in practical use", if the caulking pin 1*a*, after being deformed by the caulking process, has an outer diameter d of more than 9.0 mm, at a deformed head portion thereof, and a height H of not more than 3.5 mm, and there are less slits or crushes; A indicates "little difficultly in practical use", if the caulking pin 1*a*, after being deformed by the caulking process has an outer diameter d of less than 9.0 mm, at a deformed head portion thereof, and a height H of more than 3.5 mm; and × indicates "not agreeable in practical use", if the sample has slits or crushes and it is difficult to use.

TABLE 1

| Pressure (Kgf) | Ampere of Current (A) | Time of Current Supply (sec) 0.2 | 0.4 | 0.8 | 1.2 | 1.6 |
|---|---|---|---|---|---|---|
| 350 | 3,000 | | | | x d: 7.1<br>H: 5.2 | |
| | 4,000 | | x d: 7.0<br>H: 5.2 | x d: 8.0<br>H: 4.3 | | |
| | 5,000 | | Δ d: 9.0<br>H: 3.7<br>*1 | | | |
| 500 | 4,000 | | x d: 7.5<br>H: 4.7 | Δ d: 8.3<br>H: 3.9 | ○ d: 9.0<br>H: 3.5 | |
| | 5,000 | | ○ d: 9.1<br>H: 3.5 | ⊙ d: 9.8<br>H: 2.9 | ⊙ d: 10.1<br>H: 2.8 | ⊙ d: 10.3<br>H: 2.4 |
| | 6,000 | x d: 7.8<br>H: 4.4 | Δ d: 10.0<br>H: 2.5<br>*1 | Δ d: 10.6<br>H: 2.2<br>*1 | | |
| | 7,000 | x d: 10.3<br>H: 2.6 | | | | |
| 600 | 4,000 | | | ○ d: 9.0<br>H: 3.5 | ⊙ d: 9.9<br>H: 2.7 | |
| | 5,000 | | ○ d: 9.5<br>H: 3.1 | ⊙ d: 10.2<br>H: 2.5 | ⊙ d: 10.7<br>H: 2.3 | |
| | 6,000 | Δ d: 8.4<br>H: 4.0 | ⊙ d: 10.1<br>H: 2.5 | ⊙ d: 11.0<br>H: 2.2 | ⊙ d: 11.0<br>H: 2.2 | |

*1: Small slits exist

TABLE 2

| Pressure (Kgf) | Ampere of Current (A) | Time of Current Supply (sec) 0.2 | 0.4 | 0.8 | 1.2 | 1.6 |
|---|---|---|---|---|---|---|
| 700 | 4,000 | | | o d: 9.5<br>H: 3.3 | o d: 9.3<br>H: 3.3 | |
| | 5,000 | | x d: 9.5<br>H: 3.2 | ⊙ d: 10.2<br>H: 2.5 | | |
| | 6,000 | Δ d: 8.7<br>H: 3.9 | ⊙ d: 10.1<br>H: 2.7 | ⊙ d: 10.3<br>H: 2.3 | ⊙ d: 11.1<br>H: 2.0 | |
| | 7,000 | Δ d: 10.0<br>H: 2.4<br>*2 | Δ d: 11.0<br>H: 2.4<br>*2 | | | |
| 800 | 4,000 | not deformed | x d: 7.8<br>H: 4.5 | o d: 9.0<br>H: 3.4 | ⊙ d: 10.3<br>H: 2.7 | |
| | 5,000 | x d: 7.5<br>H: 4.6 | ⊙ d: 9.8<br>H: 2.6 | ⊙ d: 10.7<br>H: 2.4 | | |
| | | Change of Time (sec.) for Current Supply 0.1 | 0.2 | 0.3 | 0.4 | 0.5 |
| | 6,000 | | o d: 9.5<br>H: 3.0<br>less crushes | ⊙ d: 19.2<br>H: 2.7 | ⊙ d: 10.7<br>H: 2.3 | Δ d: 10.8<br>H: 2.3<br>*1 |
| | 7,000 | x d: 7.5<br>H: 4.6 | x d: 10.7<br>H: 2.5<br>*1 | x d: 11.0<br>H: 2.3<br>*1 | Δ d: 11.2<br>H: 2.0<br>*1 | |
| | 8,000 | x Excess crushes | | | | |

*1: Small slits exist
*2: Melt aluminium. scattered and attached on surface

As shown in Tables 1 and 2, it was found that a most favorable caulking result can be obtained if the caulking operation is conducted under the conditions such that a tungsten electrode is used as the electrode, and with respect to the caulking pin 1*a* made of a magnesium alloy (the diameter thereof being 6.9 mm), the pressure exerted between said upper and lower electrodes 3 and 4 is 500–800 Kgf, i.e., 13.4–21.4 Kgf/mm$^2$ if represented per a unit area, the current ampere is 4,000–6,000 A, i.e., the electric current density is 100–160 A/mm$^2$, and the electric power supply time is 0.2–1.6 sec.

As mentioned above, according to the present invention, since at least one of the electrodes that contact the caulking pin of the work is made of a material having a low thermal diffusivity and difficulty alloying with magnesium, and the caulking or welding conditions are selected appropriately as mentioned above, it becomes possible to use a magnesium or a magnesium alloy as the material to be worked under a caulking process that has been considered impossible in the prior art. Therefore, the present invention can be effectively applied in various fields of the art, such as a lightening technique in articles of a vehicle.

It should be understood by those skilled in the art that the foregoing description relates to only a preferred embodiment of the disclosed invention, and that various changes and modifications may be made to the invention without departing from the spirit and scope thereof.

We claim:

1. An electrical caulking method for a work comprising magnesium or a magnesium alloy and including a body and a caulking pin integrally projecting from the body, the method being carried out using an electric caulking apparatus having first and second electrodes, the first electrode made of a material difficult to alloy with magnesium or a magnesium alloy and containing at least 75.0% tungsten and the remainder, if any, copper, comprising the steps of:

holding said work between the first and second electrodes in such a manner that the first electrode contacts the caulking pin and the second electrode contacts the body, applying an electric current between the first electrode and the second electrode, and exerting pressure between the first electrode and the second electrode, thereby caulking the caulking pin into a desired shape.

2. The method as set forth in claim 1, wherein the second electrode which contacts the body of the work is made from a Cr-Cu alloy.

3. The method as set forth in claim 1, wherein said second electrode is a Cr-Cu alloy containing 1 to 5% Cr and the remainder Cu.

4. The method as set forth in claim 1, wherein the electric current has a density of 100–160 A/mm$^2$.

5. The method as set forth in claim 1, wherein the pressure between the first and second electrodes is 13–22 Kgf/mm$^2$ and is exerted between the first and second electrodes.

6. The method as set forth in claim 1, wherein the electric current is an alternating electric current supplied between said first and said second electrodes.

7. The method of claim 1, wherein the caulking pin made of magnesium or a magnesium alloy is plastically deformed, thereby obtaining a good caulking effect.

8. The method of claim 1, wherein the pressure exerted between said first and said second electrodes is 350–800 Kgf and a current ampere between 3,000–8,000 A, is supplied and electric power supply time is between 0.2–1.6 sec.

9. The method of claim 8, wherein said caulking pin is made of a magnesium alloy having a diameter of 6.9 mm, and the current ampere is 4,000–6,000 A.

10. The method of claim 1, wherein said pressure exerted between said first and said second electrodes is exerted at the same time that the electric current is applied between said first and said second electrodes.

11. An electrical caulking system for attaching a first member together with a second member, said system being carried out using an electric caulking apparatus having first and second opposing electrodes, said first electrode being made of a material difficult to alloy with magnesium or magnesium alloy and consisting of at least 75.0% of tungsten and the remainder, if any, copper, at least said first member being made of magnesium or a magnesium alloy and comprising a body and a caulking pin integrally projecting from said body, and said second member having a caulking pin inserting hole at a corresponding position aligned with said caulking pin; said system comprising the steps of:

positioning said first and said second members together in such a manner that said caulking pin is inserted into said caulking pin inserting hole aligned with said caulking pin;

holding said first and second members between the opposing first and second electrodes in such a manner that said first electrode contacts said caulking pin and said second electrode contacts said body;

supplying an electric current between said first and said second electrodes;

exerting a pressure between said first and said second electrodes for caulking said caulking pin into a desired shape; and forming said first electrode which contacts said caulking pin of the work from a material consisting of at least 75.0% tungsten and the remainder, if any, copper.

12. The system of claim 11, wherein the second electrode is specifically a Cr-Cu alloy consisting of 1 to 5% Cr and the remainder Cu.

13. The system of claim 11, wherein said pressure exerted between said first and said second electrodes is exerted at the same time that the electric current is applied between said first and said second electrodes.

14. An electrical caulking method for a work comprised of magnesium or a magnesium alloy and comprises a body and a caulking pin integrally projecting from said body, said method being carried out using an electric caulking apparatus having first and second opposing electrodes, the first electrode containing at least 75.0% tungsten and the remainder, if any, copper, comprising the steps of:

holding said work between the opposing first and second electrodes in such a manner that the first electrode contacts said caulking pin and the second electrode contacts said body, applying an electric current between said first and second electrodes, exerting pressure between the first electrode and the second electrode, thereby caulking the caulking pin into a desired shape, wherein said first electrode has low thermal diffusivity and is difficult to alloy with magnesium or a magnesium alloy.

15. The method of claim 14, wherein the second electrode is a Cr-Cu alloy consisting of 1 to 5% Cr and the remainder Cu.

16. The method as set forth in claim 14, wherein said second electrode is a Cr-Cu alloy containing 1 to 5% Cr and the remainder Cu.

* * * * *

UNITED STATES PATENT AND TRADEMARK OFFICE

CERTIFICATE OF CORRECTION

PATENT NO. : 5,461,768

DATED : October 31, 1995

INVENTOR(S) : Jiro Matsumoto, et al

It is certified that error appears in the above-indentified patent and that said Letters Patent is hereby corrected as shown below:

On the title page, item [30], should read

Foreign Application Priority Data

Apr. 10, 1992 [JP] Japan ..... 4-90792

Signed and Sealed this

Ninth Day of January, 1996

*Attest:*

Bruce Lehman

BRUCE LEHMAN

*Attesting Officer*

*Commissioner of Patents and Trademarks*